US006045463A

United States Patent [19]

Cass

[11] Patent Number: 6,045,463

[45] Date of Patent: Apr. 4, 2000

[54] BASKETBALL PRACTICE DEVICE

[76] Inventor: Norman A Cass, 54 Foster Rd., Southwick, Mass. 01077

[21] Appl. No.: 09/149,107

[22] Filed: Sep. 8, 1998

Related U.S. Application Data

[63] Continuation-in-part of application No. 08/401,080, Jun. 13, 1996, abandoned.

[51] Int. Cl.[7] ..... A63B 69/00

[52] U.S. Cl. ..... 473/433; 473/431

[58] Field of Search ..... 473/431, 432, 473/433, 436, 447, 448, 449; 273/394, 396

[56] References Cited

U.S. PATENT DOCUMENTS

| | | | |
|---|---|---|---|
| 3,814,421 | 6/1974 | Spier, Jr. | 273/396 X |
| 3,901,506 | 8/1975 | Caveney | 473/433 |
| 4,506,886 | 3/1985 | Lamb, Sr. | 473/447 |
| 4,714,248 | 12/1987 | Koss | 473/436 |
| 5,165,680 | 11/1992 | Cass | 473/433 |
| 5,171,009 | 12/1992 | Filewich et al. | 473/433 |
| 5,348,290 | 9/1994 | Matherne et al. | 473/433 |
| 5,409,211 | 4/1995 | Adamek | 473/433 |
| 5,443,258 | 8/1995 | Kinsella | 473/433 |
| 5,487,540 | 1/1996 | Bixler et al. | 473/436 |

FOREIGN PATENT DOCUMENTS

WO 92/06747 4/1992 WIPO .

OTHER PUBLICATIONS

Boston Celtics Pride, vol. 3, Issue 5, No. 45, p. 21: Cass U.S.A. Shootout; copy in 473/FOR. 101, Jan. 1988.

*Primary Examiner*—Raleigh W. Chiu

[57] ABSTRACT

The apparatus of the within invention is quite sophisticated. Its primary purpose was to adapt a rotatable return of ball on an existing basketball hoop. The principal feature is an inverted L-shaped circular ring that conforms to the locus of the hoop. The inverted L-shaped ring sets down on the hoop with the vertical flange extending downward and inside the hoop while the horizontal flange rests on the hoop. Extending downwardly a sufficient distance below the hoop is a mechanism that grabs the ball, squeezes it, and then throws it back in the direction of the player who has been shooting the ball at the hoop. The throwing mechanism comprises of a motion system for turning roller, one of which squeezes the ball, and feeds it and the other of which spins and throws the ball at the player.

2 Claims, 6 Drawing Sheets

BASKETBALL PRACTICE DEVICE

CROSS-REFERENCE TO RELATED APPLICATIONS

This application is a continuation-in-part of application Ser. No. 08-401/080 filed Jun. 13, 1996, now abandoned.

FIELD OF INVENTION

The within invention is concerned with a device that returns a basketball to the player who is practicing. The within invention is an improvement over the prior art and enables the player to have the basketball returned to him at many different locations from the hoop and backboard. The backboard apparatus may be rotated on the hoop easily to different locations.

BACKGROUND OF THE INVENTION

Basketball has become an important winter sport, not only in the United States, but throughout many countries of the world, and many people devote considerable time to develop their skills in order to become professionals, to gain scholarships to college, and for recreation purposes. It takes a great deal of practice to develop skills for shooting into the basket from different locations. One of the problems of practice is not only retrieving the ball, but also not being able to shoot at the basket from different locations.

It is an object of the within invention to provide an improvement over all practice basketball devices by having a return novel arrangement whereby the ball is returned to the player at the location from which he is shooting the basketball.

It is an additional object of the within invention to provide a low cost, simple, but efficient basketball practice device that is easily maintained.

It is a further object of the within invention to provide a practice basketball hoop that eliminates the necessity of having a plurality of basketballs in order to practice.

It is yet a further object of the within invention to provide a device with simple mechanical arrangements for returning the basketball to the location where the player is.

These components are simple to manufacture, and of low cost, enabling most basketball players to be able to afford same.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide data concerning a typical embodiment of the invention and are not therefore to be considered limiting of its scope, the invention will be described and explained with additional specificity and detail through the use of the accompanying drawings in which:

Reference is made to the view of FIG. 3. The interverted L-shaped circular rim 23, rests on the basketball hoop 12, which is connected in the conventional manner to the backboard 1 (FIG. 1), and from which hoop the conventional basketball netting 2 is attached. FIG. 4 shows the inverted L-shaped circular rim 23 surrounding the basketball hoop 12. FIG. 4*a* shows how rim 23 rests on hoop 12. In order to lock it into position, FIG. 4B demonstrates in detail the method. The rim 23 is mounted on the horizontal mounting plate 14. Plate 14 is welded to both rim 23 and the vertical mounting plate 9. A vertical finger 6 extends downwardly from the plate 14, near the basketball hoop 12. A screw 3 passes through an opening in finger 6. A locking nut 4 is threaded on screw 3. When screw 3 is tightened so as to make contact with the hoop 12 at 5, the locking nut is rotated in tight contact with finger 6, so that the hoop and rim are tightly secured. There are symmetrical fingers 6 and hardware on both sides of the rim 23. See FIG. 3.

Figure 3:
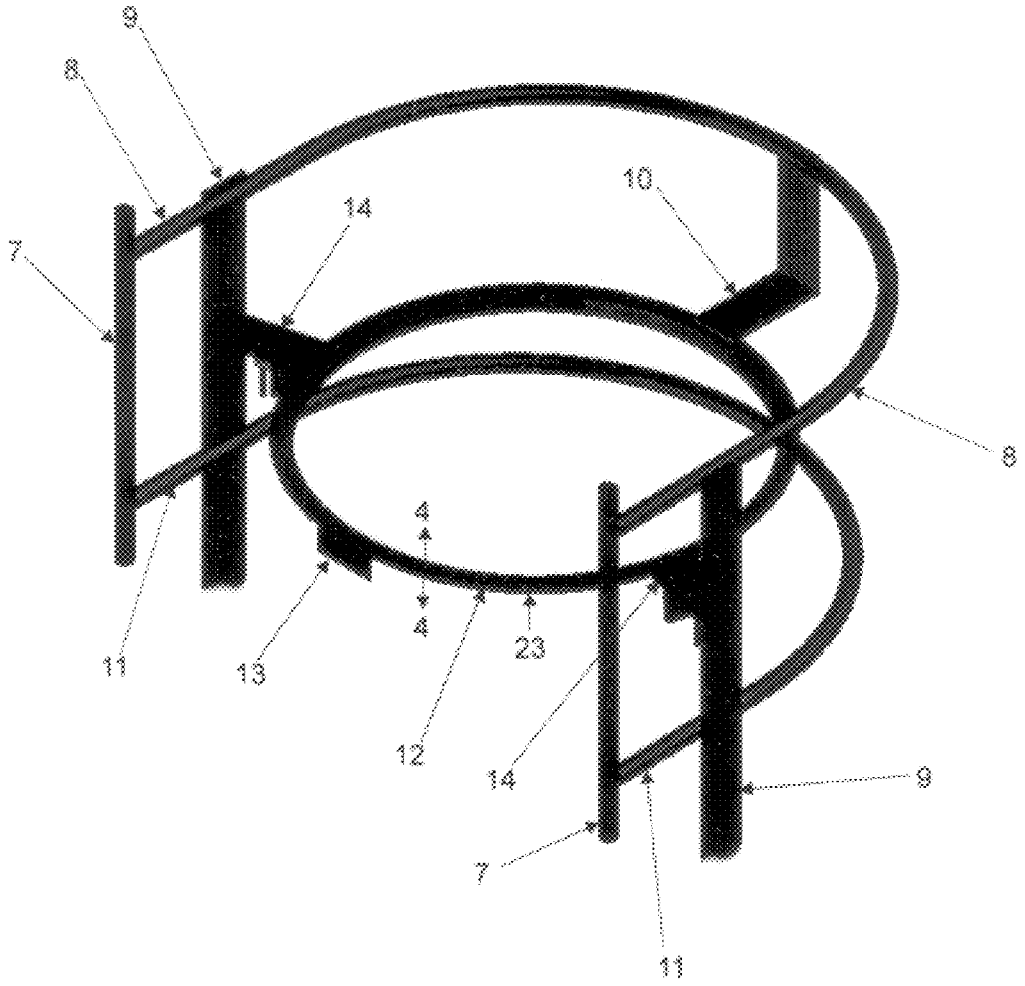
FIG. 3 is an exploded view of FIG. 2 in diagrammatic form.

The semi-circular upper strut 8 is parallel to the semi-circular lower strut 11. There is a perpendicular strut 7 connected to each end of the strut 8 and the strut 11 forming a cylindrical frame. The vertical mounting plate adds further strength to the struts 8 and 11, being welded to both, at a position located at the quadrant of the basketball hoop 12. As previously described and observed in FIG. 3, there are two vertical mounting plates 9 on each side of the hoop 12. The horizontal plate which extends from the vertical plates 9 are welded to the inverted L-shaped rotatable rim 23.

Since rim 23 sets on the basketball hoop 12, it will, with all of its connected parts, rotate as a complete unit.

An additional brace 10 which is flat with two arms extending upwardly and horizontally, forming an L-shape is welded to the rim 23 and the upper strut 8, strengthening the frame of the unit. Member 10 also acts as a target and is painted a bright color to assist the player in aiming at the basket. When the unit is rotated, L-member 10 also is rotated on the basketball hoop 12.

There is a flange 13 welded to the inverted L-shaped rim 23, which is also painted a bright color and acts as the front target.

Figure 1:
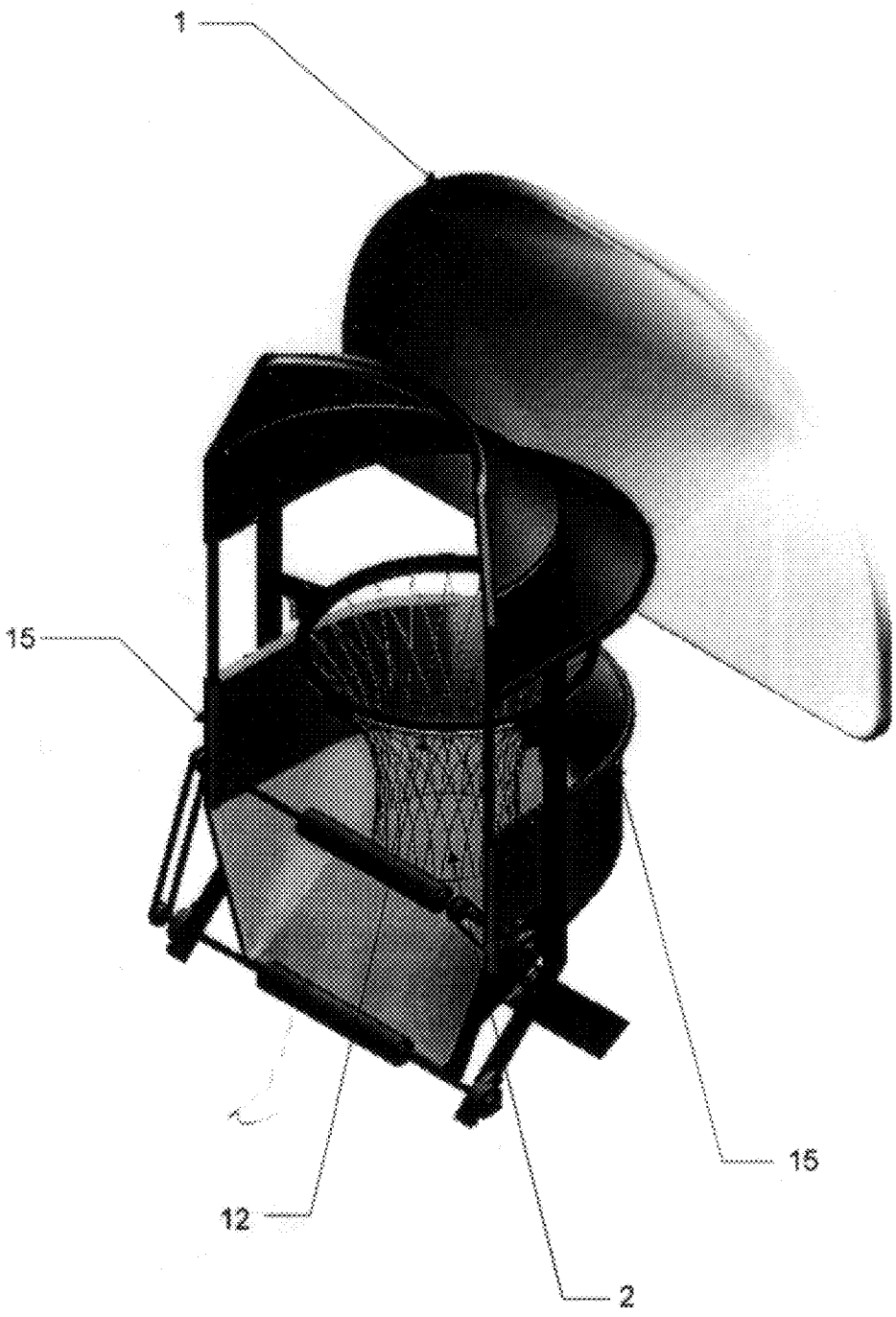
FIG. 1 is a perspective view of a presently preferred embodiment of the ball return apparatus in active mode attached to a basketball hoop.

In the finished mode an upper chute 15 surrounds the various struts described as seen in the view of FIG. 1. The lower chute 16 created a platform for the basketball after it drops through the hoop.

Figure 2:
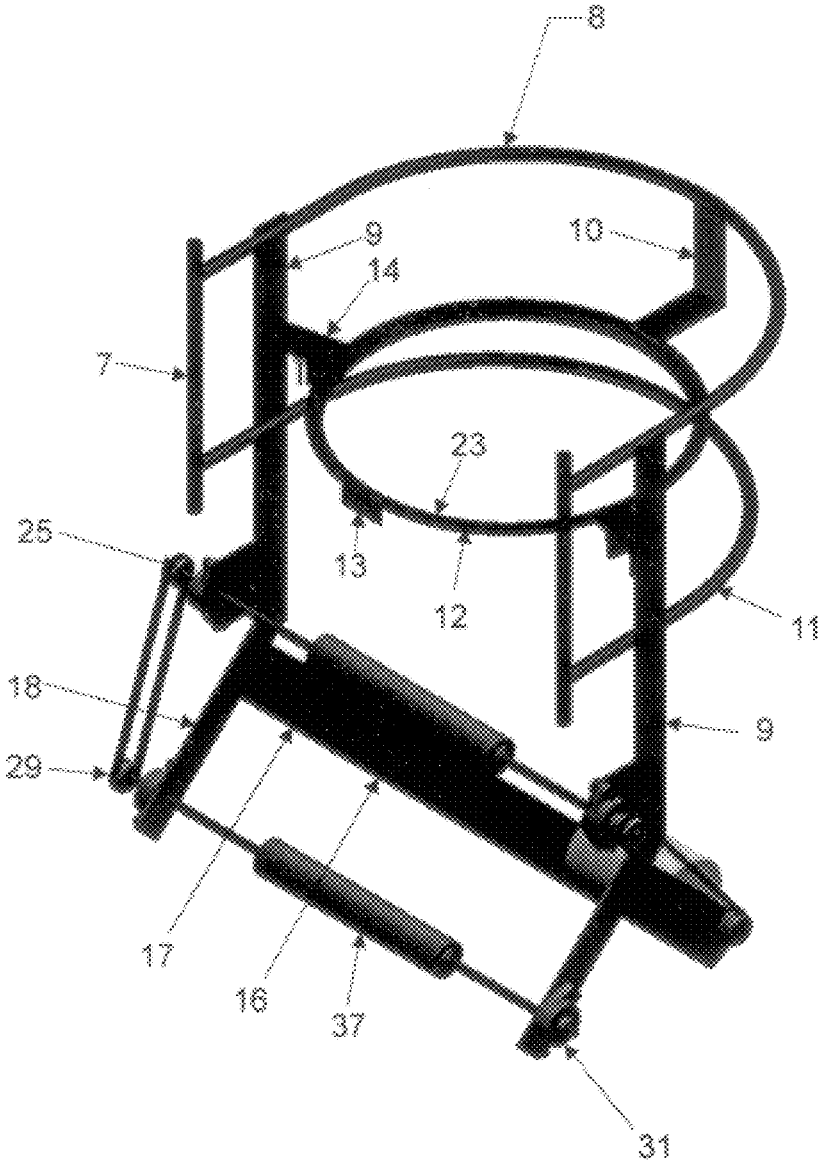
FIG. 2 is a skeleton view of the apparatus shown in FIG. 1, wherein the apparatus has been lifted off the basketball hoop and placed in the passive mode.

Extending down from the vertical mounting plates are a diagonal lower support extension bracket 18, (see FIG. 2). The need for the brackets 18 is to mount the return ball assembly which is disclosed in detail in FIG. 2, FIG. 5, and FIG. 6.

Mounted on the support bracket 18 is the busing and housing 26 which is connected to a transmission system, a pulley 29, a belt 28, an upper pulley 25, to which the belt connects same with pulley 29. The shaft of axle 34 supports the low roller 37 which is locked on the shaft 34 by means of lock screw 36 passing through the flange 35 and turned tight against the shaft 34. The bearing collar 30 is also secured to the shaft 34 on the other side of the bearing assembly 26. The bolts 31 and 33 mount the bearing assembly. A washer 32 prevents the bolts 31 and 33 from loosening.

Figure 5:
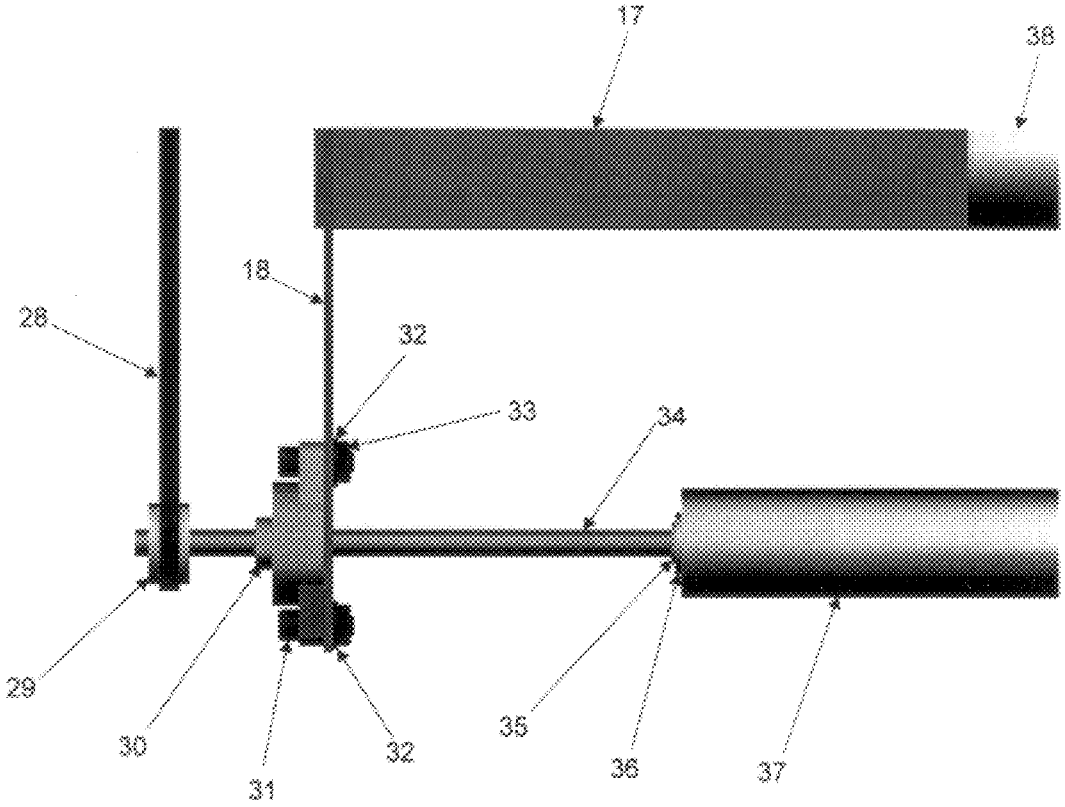
FIG. 5 is an exploded front elevational view showing a portion of the roller assembly that throws the ball to the player.
Figure 6:
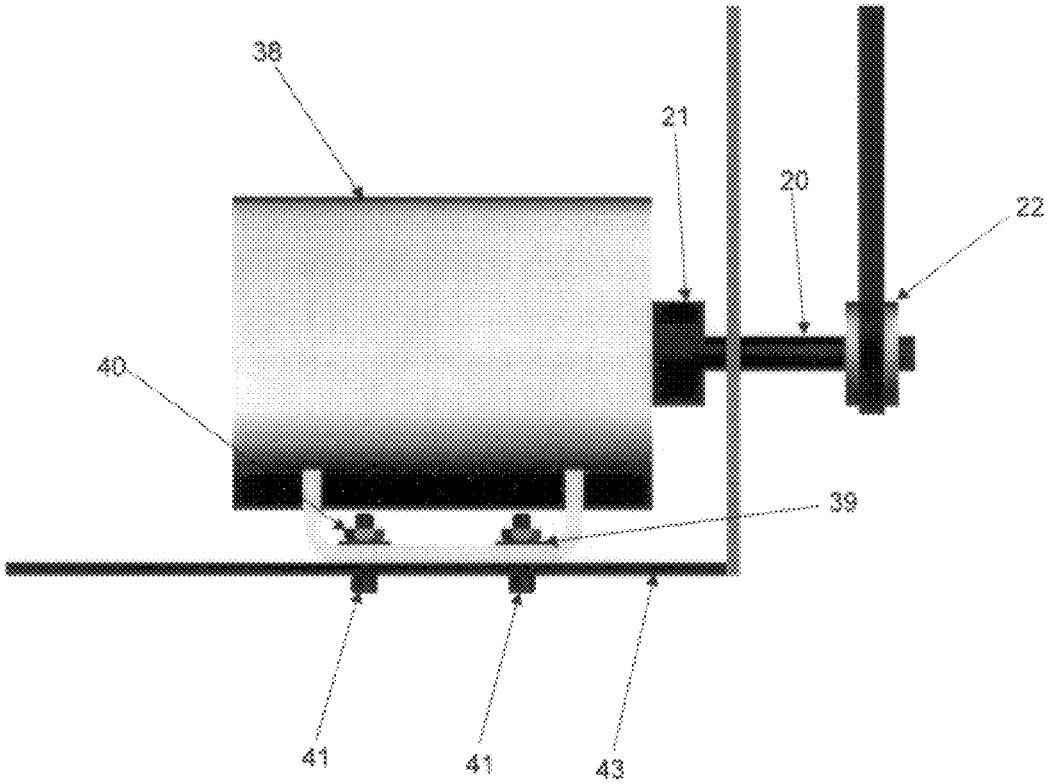
FIG. 6 is a plan view looking from the rear at the upper roller assembly as shown in FIGS. 1 and 2.

The upper roller 38 is mounted on the upper shaft or axle 20, which in FIG. 5 is partially concealed by the motor mounting plate 17, and is screwed to the shaft 20 by the upper roller lock busing 21. Axle or shaft 20 is connected to the transmission system by its pulley 22 which is rotated by the belt 24, which is connected to motor pulley. The motor mounting bracket 43 is seen on a top view in FIG. 6 with the nut and bolt assemblies shown as 39, 40, and 41.

Figure 4A:
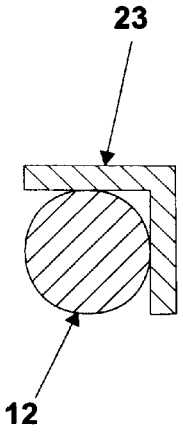
FIG. 4A is a detailed view of the mechanism for locking the hoop to the inverted L-shaped circular rotatable and removable rim.
Figure 4:
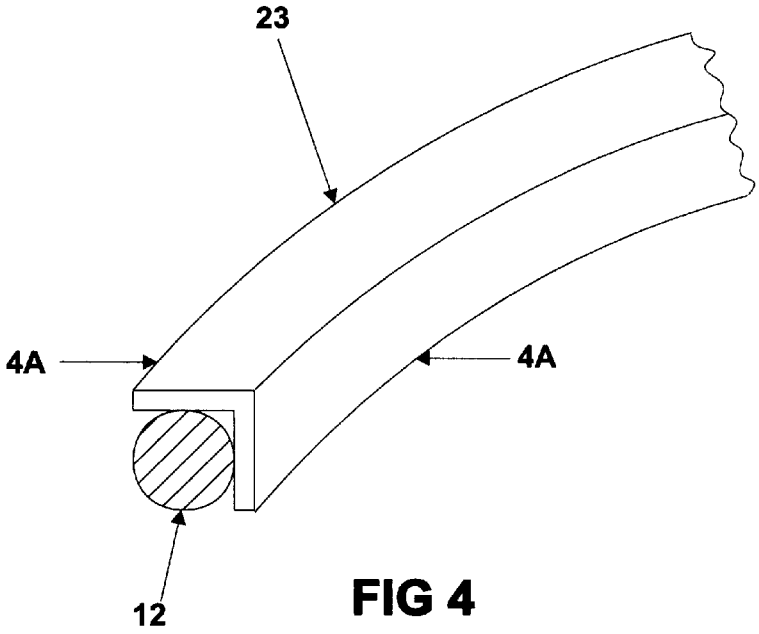
FIG. 4 is a cross section view on line 4—4 of FIG. 3 showing how the inverted L-shaped moveable rim rests on the basketball hoop.
Figure 4B:
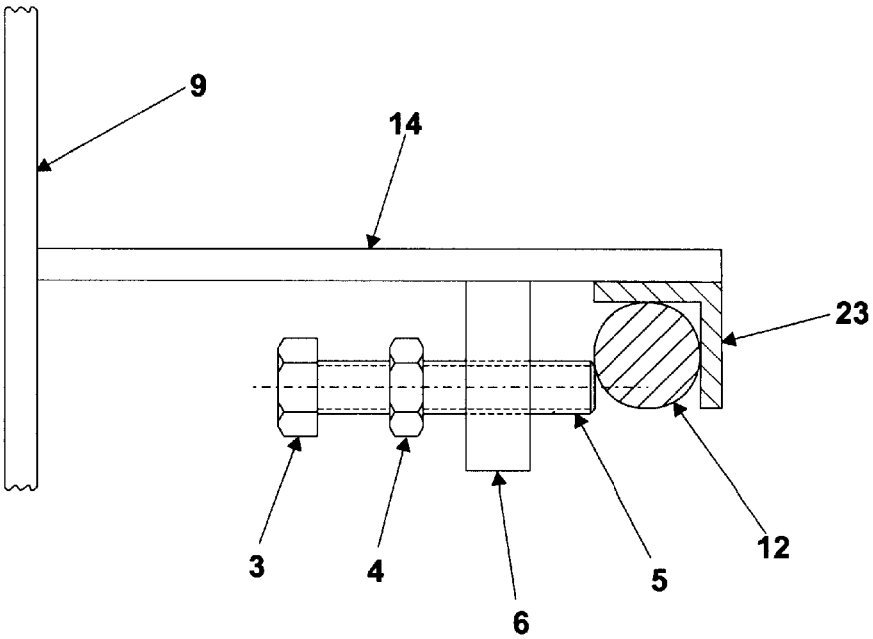
FIG. 4B is an exploded diagrammatic view of the mechanism mounted on the horizontal mounting plate for locking the basketball rim into the position of the inverted L-shaped rim.

In operation, the total assembly sets on the basketball hoop 12 since the inverted L-shaped rim 23 sets on top of it. It is locked by tightening the screw 3 and the lock nut 4 as described, and as shown in FIG. 4B.

When the player throws the ball into the basketball hoop 1, the ball drops down into the upper chute 15 whereby the ball is compressed and moved by the rotation of the roller 38 in a clockwise rotation and is forced down to the lower roller 37 on the surface of the lower chute 16, whereby the rotation of the lower roller in a counter clockwise direction thrusts the ball back in the direction of the player.

All of the parts described are connected directly or indirectly to the inverted L-shaped rim 23 which rests on the basketball hoop 12. When the rim 23 rotates, the entire unit rotates with it.

A motor, not shown in the drawings of light weight and sufficient horsepower, is mounted on the motor mounting bracket 43 in the conventional manner. Its drive shaft is connected to the upper pulley 22 in the conventional manner.

I claim:

1. A basketball return apparatus rotatable about an essentially vertical axis, said apparatus comprising:

a substantially semi-circular upper strut, a substantially semi-circular lower strut and a plurality of substantially vertical mounting plates connecting said upper and lower struts;

a pair of substantially vertical struts, each of said substantially vertical struts being mounted to the ends of said upper and lower struts;

a substantially circular, movable rim having a substantially inverted L-shaped cross-section, said L-shape defining a substantially hornizontal arm and a substantially downwardly-extending arm;

said movable rim further adapted to be substantially the same size as a basketball hoop, wherein said substantially horizontal arm is able to rest on the hoop and said substantially downwardly-extending arm is adapted to extended over the thickness of the hoop;

a substantially L-shaped brace connecting said rim to said upper strut;

a plurality of substantially horizontal mounting plates connecting said movable rim to said substantially vertical mounting plates;

a plurality of support brackets attached to the lower ends of said substantially vertical mounting plates; and, a return mechanism mounted on said support brackets for engaging, squeezing and returning a basketball to a player;

said return mechanism including an upper roller and a lower roller, a lower chute mounted below said movable rim for guiding a ball to said rollers, a transmission connecting said rollers, and a motor for imparting rotary motion to said transmission and rollers.

2. The basketball apparatus as described in claim 1, further comprising:

an axle extending through the center of each said roller;

bearing collars interconnecting said axles and said support brackets;

means for securing said bearing collars to said support brackets;

said transmission comprising pulleys mounted on said axles and belts engaging said pulleys.

* * * * *